US005197401A

United States Patent [19]

Finley et al.

[11] Patent Number: 5,197,401

[45] Date of Patent: Mar. 30, 1993

[54] ROTATING RING MAST SAILING VESSEL AND A METHOD OF VESSEL OPERATION

[75] Inventors: Warren Finley, 564 Vista La., Laguna Beach, Calif. 92651; John E. Duquette, Laguna Niguel, Calif.

[73] Assignee: Warren Finley, Laguna Beach, Calif.

[21] Appl. No.: 754,741

[22] Filed: Sep. 4, 1991

[51] Int. Cl.[5] ..... B63H 9/06

[52] U.S. Cl. ..... 114/39.1; 114/91; 114/102

[58] Field of Search ..... 114/39.1, 102, 103, 114/91

[56] References Cited

U.S. PATENT DOCUMENTS

| | | | |
|---|---|---|---|
| 685,943 | 11/1901 | Pool | 114/35.1 |
| 2,713,392 | 7/1955 | Von Karman et al. | 114/39.1 |
| 3,195,494 | 7/1965 | Robin | 114/39.1 |
| 3,332,383 | 7/1967 | Wright | 114/39.1 |
| 3,580,203 | 5/1971 | Martin | 114/39.1 |
| 3,802,371 | 4/1974 | Jastrab | 114/102 |
| 3,968,765 | 7/1976 | Menegus | 114/102 |
| 4,116,151 | 9/1978 | Guthrie | 114/102 |
| 4,453,483 | 6/1984 | Shallenberger | 114/102 |
| 4,506,620 | 3/1985 | Gerr | 114/102 |
| 4,685,410 | 4/1987 | Fuller | 114/102 |
| 4,702,191 | 10/1987 | Minami et al. | 114/106 |
| 4,911,093 | 3/1990 | Estrup | 114/106 |

FOREIGN PATENT DOCUMENTS

| | | | |
|---|---|---|---|
| 1224690 | 3/1971 | United Kingdom | 114/39.1 |

*Primary Examiner*—Sherman Basinger
*Attorney, Agent, or Firm*—Knobbe, Martens, Olson & Bear

[57] ABSTRACT

A system for powering a water vessel having as its principal components rectangular sails secured to a rectangular frame which in turn is attached to an annular mast rotatably mounted on a plurality of supports rigidly affixed to the vessel. In a second system the supports are rotatably mounted on the vessel in a manner such that the supports and the annular mast may rotate independently of each other.

26 Claims, 4 Drawing Sheets

ROTATING RING MAST SAILING VESSEL AND A METHOD OF VESSEL OPERATION

FIELD OF THE INVENTION

The present invention relates generally to an apparatus for powering a sailing vessel and more particularly to an improved technique for supporting and maneuvering sails.

BACKGROUND OF THE INVENTION

Sailing vessels have been known and used for thousands of years and seemingly since before the annals of history. Though primarily used as pleasure craft today, sailing vessels are also often used for competitive racing purposes. As such, sailboat designs are being continuously revised to achieve greater speeds and maneuverability. Indeed, sailboat racing requires such a high level of functional sophistication that design and manufacturing concepts are even being adapted from the cutting edge of space technology.

Conventional sailing vessels generally consist of a buoyant hull (or multiple hulls in the case of catamarans or trimarans) upon which one or more masts extends upwardly from the hull to support one or more sails. A downward extension of the hull, called the keel, traverses the bottom of the hull from bow (front) to stern (rear) and functions to stabilize the sailing vessel against the countervalent force of the wind. A ruder used for steering the vessel is positioned below the stern and is controlled with a tiller or wheel from the deck of the hull.

A typical mast consists of a rigid vertical column which is securely attached to the hull and supports an orthogonally-positioned boom extending outwardly from the mast. Early sailing vessels, which comprised the majority of pre-twentieth century naval fleets, are easily recognizable for their majestic appearance. These early vessels often include two or three masts which supported several horizontally-positioned "yards" spaced vertically and which extended across the mast, each yard supporting a square sail. While some modern sailing vessels continue to employ a similar configuration, most others employ a single mast wherein a boom, which functions similarly to a yard, is positioned on the lower portion of the mast. The planar area defined by the vertically-rising mast and the horizontally-extending boom is occupied by a sail, generally triangular in shape. The sail is securely supported by both the mast and the boom.

While the mast remains steadfastly secured to the hull, the boom is permitted to rotate about the mast, allowing the sail to be movably positioned relative to the hull in order to capture the wind from varying wind directions. With sailing vessels in general, translation of the vessel in water depends upon the forces of the wind. The sails are strategically positioned to capture sufficient wind to power the vessel. In an overly simplified explanation of the mechanics of sailing, the captain of a sailing vessel is able to control the direction of movement by simply steering the rudder with the steering wheel or tiller. Simultaneously, the captain is able to power the vessel by positioning the boom with respect to the wind direction in order to capture the forces of the wind. With this combination of control, a sailing vessel has virtually 290° of directional freedom with respect to any present direction of the wind. Of course, if the wind changes directions, the vessel may be able to head directly upon a desired course which otherwise required back and forth tacking as will be described below.

For simplification purposes only, assume the wind is heading due south out of the North (0° reference point). A sailing vessel will be permitted to travel from a direction approximately 35° NE to about 325° NW under the power of this particular wind vector. Ordinarily, a sailing vessel cannot travel directly against the wind, i.e., at a heating of 0° N. or within about a 35° arc on either side of the wind vector. If the desired course of travel requires such a 0° heading, the captain must direct the vessel in a back and forth—somewhat "zig-zag," formation, repeatedly between 35° and 325°. This approach is referred to as "tacking" or "beating" and naturally results in a slower effective travel speed than when the vessel is travelling with the wind directly at its back, i.e., at a 180° heading. This latter approach is referred to as "running" and provides the greatest opportunity to capture the full force of the wind.

With any particular wind direction, there is a relative position of the sail to the vessel which is optimal, thereby capturing a maximum amount of wind forces. The wind direction in relation to the desired direction of motion determines the proper sailing attitude. If the wind is behind the vessel when the vessel is headed in the desired direction of travel (i.e., 180°), a virtually straight path can be traversed. In this instance, the sails are preferably extended perpendicular both to the wind and the hull wherein aerodynamic wind forces acting normally on the sail provide the propulsive force. When it is desired that the vessel be directed in a heading oblique to the direction of the wind, but at an angle greater than 35°, the sail or sails are "trimmed," i.e., they are pulled closer to the longitudinal axis of the vessel. If the wind is blowing at an angle less than about 35° from the desired course of travel, the sail or sails must be fully trimmed and brought as close to parallel with the longitudinal vessel axis as possible. Intermediate sailing attitudes are termed close reach, beam reach and broad reach, with a close reach being closest in sailing mechanics to "beating," described above. Under close reach and beating approaches, the sails function not only to capture the wind directly, but also function effectively as air foils. With conventional air foils such as the wing of an airplane, the force of wind passing over and under the wing provide aerodynamic lift. Analogously, the wind passing on either side of a sail provides forward propulsion because the sail is vertically oriented as opposed to a wing which is horizontally oriented. Much like the airplane wing, sail lift occurs when the wind speed over the leeward (downwind) side of the sail is less than the wind speed over the windward (upwind) side of the sail, resulting in a slight pressure differential across the sail. This pressure differential provides the force necessary to propel the vessel forward.

When the vessel is steered directly into the wind during tacking approaches, the sail or sails temporarily go limp, or luff, in mid-turn. As the vessel continues to "come about," the sail is renewably filled with wind which forces the boom to the other side of the vessel. Likewise, when turning away from the wind, called jibing, the sail is filled on one side of the vessel and suddenly forced to swing to the opposite side in one rapid change of wind direction.

As indicated above, typical single-masted sailing vessels feature a singular triangular main sail pivotable around the mast. Since the amount of power resulting from wind forces on a sail is directly related to the sail area capturing the wind, a rectangular or trapezoidal sail with the same base dimension as a triangular sail offers greater area and thus provides a greater propulsive force on the vessel. Numerous embodiments of fixed-mast, triangular sail vessels may be found in the prior art. For example, the concept of a rotatable peripheral frame with triangular sails is depicted in U.S. Pat. No. 3,195,494 to Robin. There, advantages of enhanced sail trimming and the ability to jibe safely are disclosed.

Another triangular sail configuration upon a rotating mast is shown in U.S. Pat. No. 3,968,765 to Menegus. In the Menegus device, there is no peripheral frame but the advantages gained from relative sail-hull rotation are discussed. Normally the boom is not fixed with respect to the hull and a constant desirable angle of attack towards the wind is preserved due to balancing wind moments about the pivot. This automatic following of wind shifts is termed vaning. Another vessel having triangular sails mounted on a rotatable mast is shown in U.S. Pat. No. 3,802,371 to Jastrab. In this design two identical sails are disposed symmetrically on either side of the main mast and connected together by spars at their top and bottom. At any sailing attitude other than running, one functions as a foresail and the other as a mainsail.

Sailing vessel artisans, recognizing the advantage of greater sail area, have incorporated rectangular sails on sailing vessels. In U.S. Pat. No. 685,943 to Pool, the concept of two rectangular sails disposed on either side of a main mast is described. The sails are held in separate frames which have limited rotation about the mast; however, they also have some longitudinal freedom of travel and may pivot about their extended vertical edge. A similar configuration, but with only one rectangular sail within a rotatable mast, is disclosed in U.S. Pat. No. 4,911,093 to Estrup. Tension cable supports distribute the loading about the mast so that a lighter, less sturdy structure is necessary. Additionally, the mast and horizontal booms are shaped to channel the wind more effectively onto the sail plane, reducing dead spots and tip vortices. U.S. Pat. No. 4,506,620 to Gerr discloses a more sophisticated rectangular sail/rotating mast assembly. At least one rotatable mast holding rectangular sails allows the boat to exploit fair winds (from behind) by extending the sails perpendicular to the wind. When sailing windward (into the wind) the sails are aligned more along the keel axis and thus converted to a fore-and-aft rigging.

Another area of sailboat design includes substituting airfoils for the typically pliant sailcloth. As described above, in almost all sailing approaches except "running," a conventional sail functions at least in part like an airfoil. An airfoil has a shape described by its camber (curvature) and its thickness. A neutral-camber foil is shaped like a thin symmetric teardrop, as shown in U.S. Pat. No. 4,685,410 to Fuller. There a wing-sail which consists of two vertically disposed neutral foils which are rotated about one central mast in the manner of a conventional sail is described. This concept is also disclosed in U.S. Pat. No. 3,332,383 to Wright, except that the latter also discloses variable camber foils. In the Wright patent, the foils are structurally supported by vertical masts which are pivotable thereby changing the cambers of said foils. The masts are then rotatable about a platform which is rotatable about the base of the vessel using either motor or manual drive mechanisms. An example of a plurality of air foils being rotatably supported from a lateral base frame is disclosed in U.S. Pat. No. 4,116,151 to Guthrie. The frame pivots about a vertical axis, as do the air foils within the frame, which provides for maximum freedom to orient the air foils with respect to the wind.

Despite the continuing developments of sailing vessels, there is still lacking a system for employing a plurality of rectangular or quadrilateral sails which are easily operated and functionally practical. While rectangular sails have been employed in the past, there has been missing in the prior art the ability to maneuver a plurality of rectangular sails in a manner analogous to conventional triangular sail vessels. The present invention addresses this void in the prior art.

SUMMARY OF THE INVENTION

The present invention improves upon the concept of rotating rectangular sails upon a sailing vessel in a manner which provides advantageous use of wind forces. Specifically, the invention defines a method and means for rotating a sail-supporting frame containing one or more sails relative to the sailing vessel; the sails being preferably constructed of textile material and being preferably rectangular in shape.

In a preferred embodiment, the rotating means comprises a rotatable ring member or mast supported by a plurality of stanchions rigidly fixed to the deck. The ring upon which the sail frame rests is rotatable relative to the stanchions either passively, by releasing one or more brakes or actively, by means of rollers, gears, tracks or other similar mechanisms. Specifically, ring rotation may be initiated by a motor or manual drive apparatus or, if desired, permitted to turn freely under the power of the wind (termed vaning). Appropriate braking and/or stopping mechanisms are provided on one or more of the stanchions which may be remotely or manually activated.

The rotating ring presents a novel alternative to conventional vertical masts and provides certain advantages over the prior art. For example, by eliminating a central mast, and instead distributing the weight of the booms, sails and rigging over diametrical portions of the ring, a sturdier structure results. With this configuration, longer booms and thus greater sail area can be achieved. In addition, the stress associated with a single cantilevered mast is eliminated and replaced by a system which more evenly distributes the load upon multiple supports.

The rotating ring offers another advantage in terms of the effort required to operate it. One or more drive mechanisms are provided which are located on one or more of the support stanchions distal from the axis of rotation. This moment are requires that a smaller force be necessary in order to rotate the frame as opposed to that needed at a point more proximal to the axis. Thus operation of the rotating ring is facilitated, especially when it is desired that rotation of the ring be accomplished manually.

The ring-frame assembly rotates on bearings near the top of the stanchions. The configuration allows for passengers to pass underneath without fear of being struck by the rotating boom. This greatly enhances safety as well as efficient movement about the vessel. When negotiating a turn, full attention can be paid to the tiller and rigging adjustment and thus speed up the process.

DETAILED DESCRIPTION OF THE DRAWINGS

Reference is now made to the figures wherein like parts are designated with like numerals throughout.

Figure 1:
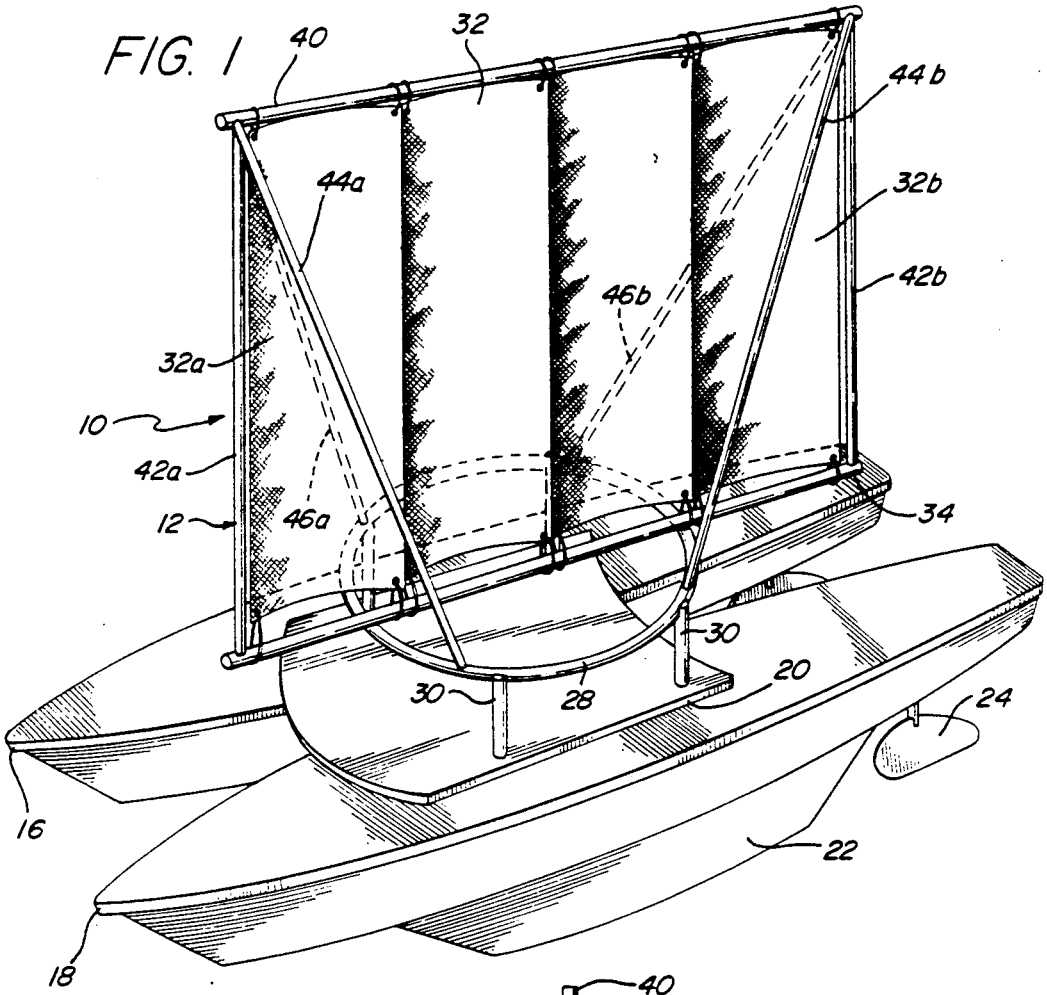
FIG. 1 is a left front perspective view of the preferred embodiment of the present invention as incorporated on a twin hull sailing vessel.

Referring to FIG. 1, the preferred embodiment of the present invention is shown comprising a sailing vessel 10 having a mast assembly 12 incorporated thereon. While the sailing vessel 10 shown in the figures comprises a twin-hulled vessel, i.e., a catamaran, the mast assembly 12 of the present invention is suitable for other configurations of sailing vessels, including, but not limited to, single hull vessels, trimarans, etc.

The sailing vessel 10 shown in FIG. 1 comprises a first hull 16 and a second hull 18 both supporting a deck 20 in a fashion so as to permit vessel operation by the crew. Both hulls have standard features common to most sailing hulls, including a central keel 22 along the bottom to provide lateral stability against the traverse winds. In addition, a rudder 24 is positioned astern (at the rear) for steering capabilities. The rudder 24 is intended to be operable by a sailor with a steering mechanism positioned on the deck 20 proximate the stern end of the vessel 10. Various prior art embodiments of the steering mechanism are contemplated, including a steering wheel or a tiller (neither shown).

In the preferred embodiment, the mast assembly 12 comprises a rotatable mast or mast member 28 supported by a plurality of stanchions 30 extending upwardly from the deck 20. The mast member 28 supports one or more sails 32, as described below, and preferably has an annular configuration permitting easy rotation. The stanchions 30 are disposed symmetrically about the deck 20 in order to provide evenly distributed load support for the mast member 28 and other components described below. In this manner, appropriate vertical and radical support is provided to the mast member 28 while permitting relative rotational movement. The top of each stanchion 30 extends above the deck 20 at a height greater than the height of an average sailor so as to avoid the impairment of free movement on the sailing vessel 10 by the crew. While four stanchions 30 are shown, the mast assembly 12 may be supported by any number of stanchions 30 as may be desired or required. The rotation of the mast member 28 may be controlled mechanically by the application of a drive motor and gear assembly (see FIG. 6), as will be discussed further below. In addition, if desired, the mast member 28 may also be rotated by simply releasing one or more stops and/or brakes positioned on the stanchions 30 and permitting the force of the wind against the sails 32 to direct movement of the mast.

The mast member 28 is preferably positioned parallel with the deck 20 of the vessel 10 and supports a sail support framework, including a lower boom 34 secured directly thereon. The lower boom 34 extends horizontally across the mast member 28 in a diametric fashion through the centerline of rotation. The sail support framework supported by the mast member 28 further comprises an upper boom 40 aligned parallel with the lower boom 34. The upper boom 40 is supported above the lower boom 34 by two vertical mast supports **42*a* and 42*b* both positioned proximate to opposite ends of the horizontal booms 34 and 40. The sails 32 are securably positioned between the upper and lower booms 40, 34 in a manner which permits their collective radial adjustment coincidentally with movement of the mast assembly 12. In the preferred embodiment, the aft leech (edge) of any one of the individual sails 32 is secured to the upper and lower booms, 40, 34 so as to preclude the sails 32 from swinging significantly away from the booms. However, it is contemplated that an alternative embodiment of the present invention would include pivotable members which are secured to, and parallel with, the booms wherein the members pivotably support the sails on the booms. With this arrangement, the member could be pivoted outwardly away from the booms so as to permit the sails to assume an oblique position with respect to the booms. Furthermore, while FIG. 1 shows the sails 32** positioned substantially adjacent each other with some space therebetween, it is contemplated that they are spaced as far or as close apart as desired to maximize the propulsive force of the wind.

Two sets of stabilizing braces **44*a*, 44*b* and 46*a*, 46*b* are provided on opposite sides of the upper and lower booms 40, 34 so as to reinforce the upper boom 40 and to distribute wind loads to the stanchions 30. In the preferred embodiment, the stabilizing braces 44*a*, 44*b*, 46*a*, 46*b* comprise rigid posts and are engaged directly to the mast member 28 at their lower ends and the upper boom 40** at their upper ends. Other configurations are contemplated for the sail support framework, each which provide adequate support for the radial adjustment of rectangular sails about a rotating mast member.

Configured to support a plurality of rectangular sails 32 therebetween, the lower boom 34 and upper boom 40 of the preferred embodiment are positioned asymmetrically with respect to the axis of rotation of the mast member 28 in order to permit sail responsiveness analogous to conventional sails. In other words, a greater amount of lower boom 34 and upper boom 40 extend toward the rear of the vessel 10 than toward the front so as to avoid equal movement being applied to the sails 32 by the wind. As such, the mast assembly 12 of the present invention will have a natural tendency to rotate so that the same end of the mast assembly will rotate downwind. In an alternative embodiment, this alignment feature can be achieved without asymmetrical positioning. By including an upper mast which is positioned oblique to the symmetrically-positioned lower boom, a greater sail area is provided on one end of the mast assembly than on the other end.

It should be noted that the sails 32 are of a rectangular configuration to improve upon the wind efficiency of the sailing vessel 10. Rectangular sails provide greater vessel propulsion than do triangular sails with the same base dimension due to the increased sail are available to the wind. While the present invention provides a unique system within which rectangular sails may be efficiently manipulated, if desired, triangular sails may be employed at the fore and rear ends of the mast assembly 12, adjacent the end rectangular sails 32*a*, 32*b*.

Advantageously, the sail support framework can be rotated with respect to the vessel hulls 16, 18 about a generally vertical axis extending through the mid-point of the rotatable mast member 28. Due to their incorporation in the sail support framework, the sails 32 are maneuverable synchronously with rotation of the mast member 28. The plane of the framework defines the amount of sail exposed to the wind, thus the individual sails can be trimmed more efficiently than would multiple sails on a conventional single mast sailing vessel.

Figure 2:
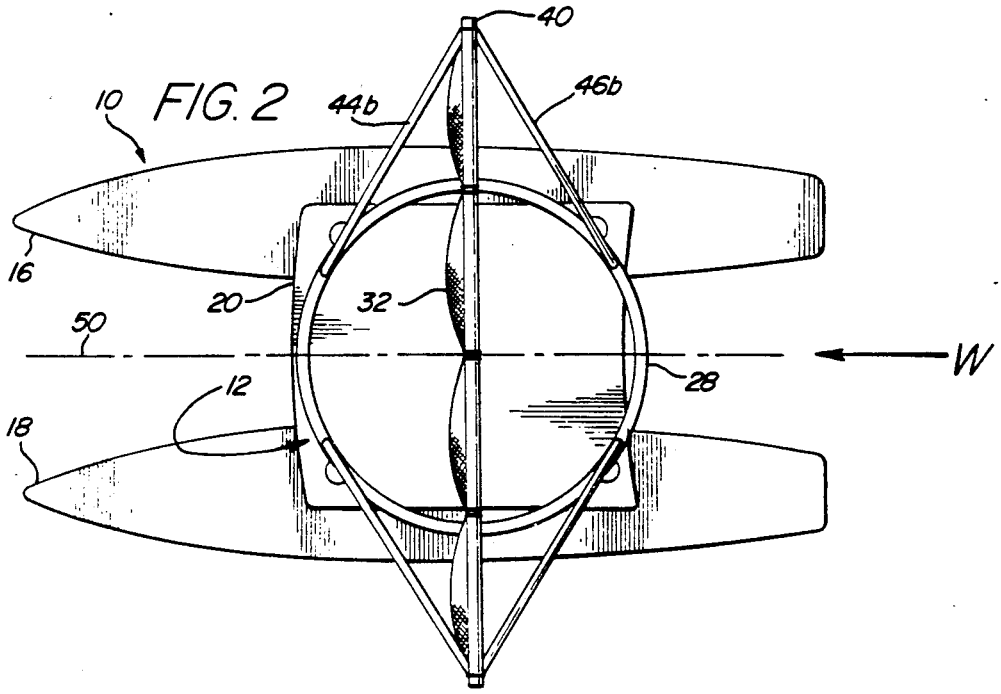
FIG. 2 is a top view of the sailing vessel of FIG. 1 wherein the mast assembly is shown in a running position.
Figure 3:
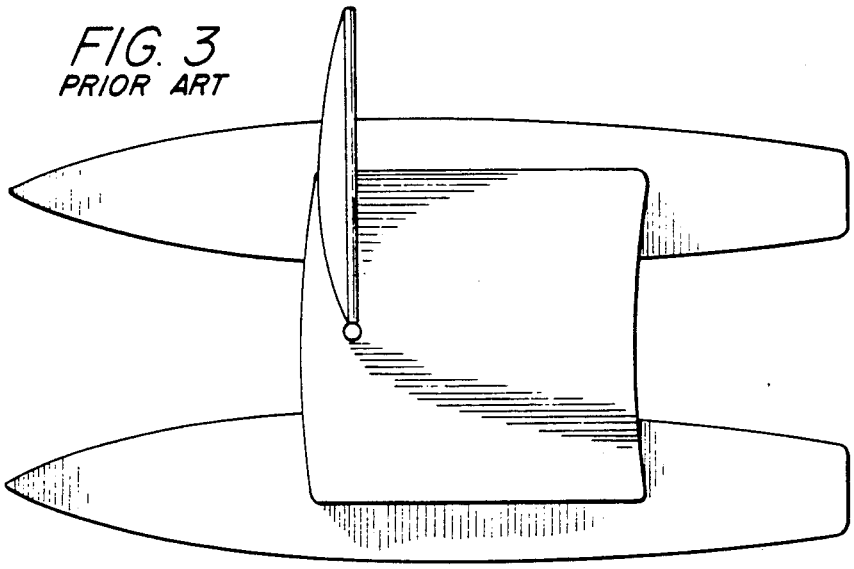
FIG. 3 PRIOR ART
FIG. 3 is a top view of a conventional sailing vessel showing the sail assembly similarly in a running position.

Referring now to FIGS. 2 and 3, other advantages of the present invention may be appreciated. In FIG. 2, the mast assembly 12 is shown from above, wherein the rotatable mast member 28 is positioned with the lower boom 34 (FIG. 1) and the upper boom 40 perpendicular to the longitudinal axis 50 of the vessel 10. This sail position is reflective of a "running" position, wherein the wind originates from directly behind the sailing vessel. With the sails in the running position, the full force of the wind may be captured so as to maximize travelling speed. With the present invention, the sail support framework extends to opposite sides of the pivot point; i.e., the focus of the mast member 28. In contrast, the conventional sailing vessel of FIG. 3 is only capable of capturing less than half of the wind as the sail merely extends to one side of the vertical mast. As such, more wind is captured by the present invention translating into great propulsive force. Even where a jib sail is used on the conventional sailing vessel, the present invention inherently incorporates greater sail area. The present invention also provides the additional advantage of stabilizing the vessel more effectively in a running or broad reach position. With a conventional vessel, there is a lop-sided distribution of sail area to one side of the mast, necessarily entailing undesired stress on the mast and hull. In contrast, the present invention incorporates a more evenly-distributed sail area on opposite sides of the axis of rotation, thereby reducing the torsional stress assumed by vessel.

Figure 4:
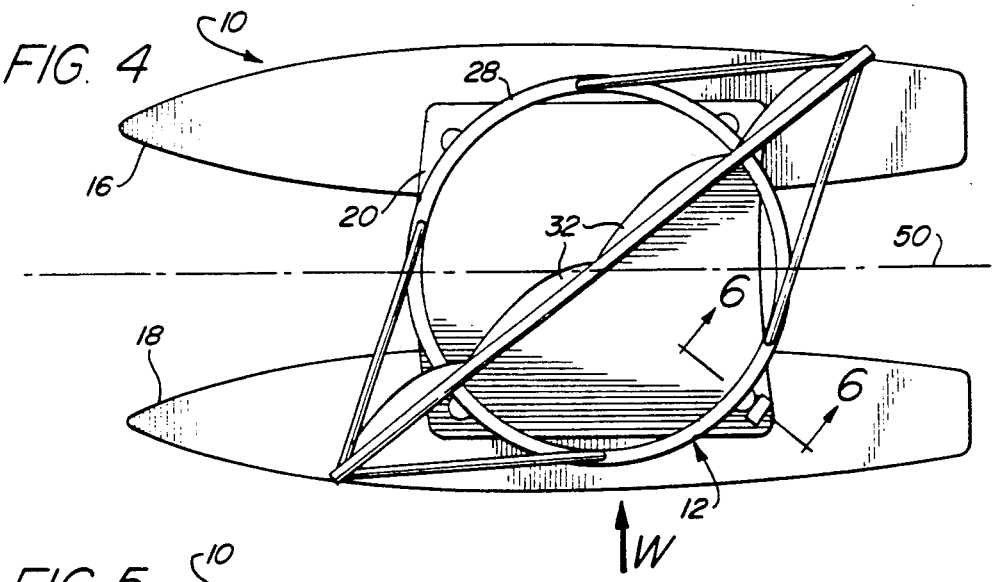
FIG. 4 is a top view of the present invention showing the mast assembly in a beam reach position.
Figure 5:
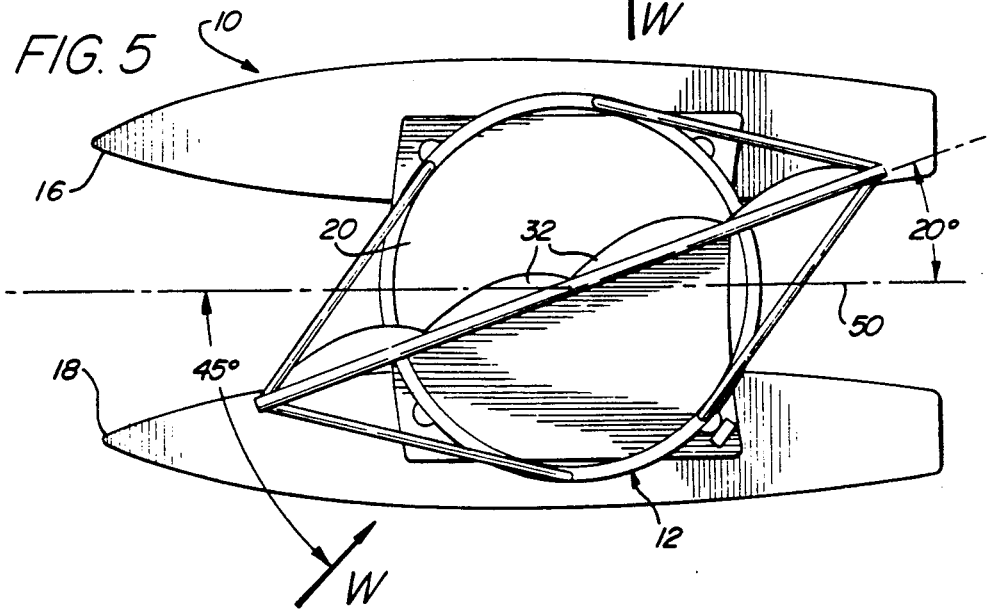
FIG. 5 is a top view of the present invention showing the mast assembly in a beating position.

Referring now to FIGS. 4 and 5, operation of the mast assembly 12 may be more fully described. As explained earlier, depending on the relative position of the sailing vessel with respect to the wind direction, it is necessary to reposition the sails to maximize the effect of wind forces. For example, when the wind originates from a direction toward the side of the sailing vessel, it is necessary to trim the sails 32 away from the position shown in FIG. 2. In other words, the sails 32 must be brought closer toward alignment with the longitudinal axis 50 of the hulls 16, 18. In FIG. 4, it can be seen that the mast assembly 12 has been rotated to an approximately 35° position relative to the longitudinal axis 50. In FIG. 5, the sails 32 are shown fully trimmed to permit the sailing vessel 10 to "tack" against the wind. There it can be seen that the sailing vessel 10 is appropriately directed at a small headwind angle. Again, in comparison with a conventional sailing vessel which has its sail trimmed to a similar position, the present invention is advantageous in that more sail area is exposed to the wind.

Like conventional sailing vessels, the present invention is designed to permit a sailor to trim the sails or let the sails out as designed in response to varying wind directions or varying course directions. However, unique to the present invention is the means for manipulating the sails to effectuate maximum sailing efficiency; namely, the mast assembly 12 described above. Operation of the mast assembly 12 depends upon controlled rotation of the mast member 28, which, in the preferred embodiment, is an annular ring supported by the stanchions 30.

Figure 6:
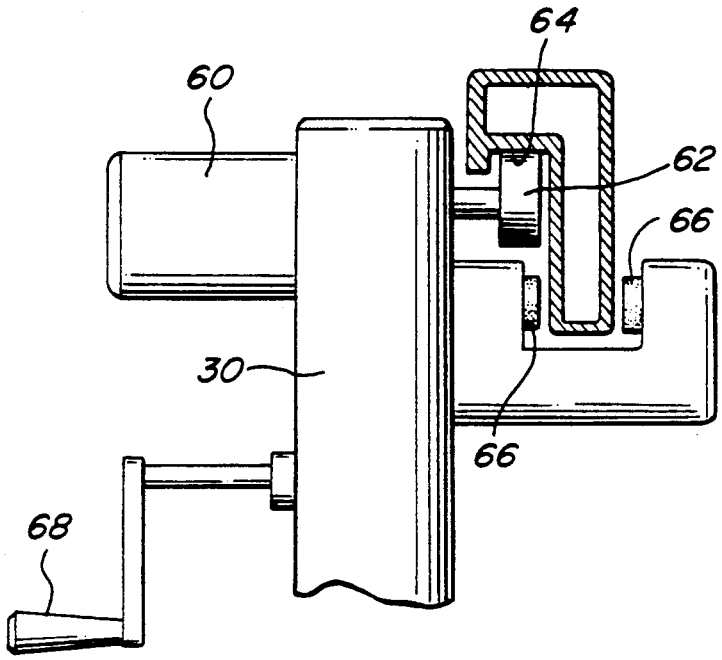
FIG. 6 is a cross-section along line 6—6 of FIG. 5 showing one embodiment of the drive mechanism for the mast assembly.

Referring now to FIG. 6, specific operation of the present invention may be described. The motive force required to operate the mast assembly 12 can be provided by an electric motor, by a manual crank, or by the wind directly. With electric motors, more than one drive assembly can be actuated simultaneously by one crew member so that a drive assembly may be positioned atop each stanchion. It is important to understand that conventional mechanical means may be employed to control rotation of the mast assembly 12; i.e., drive motors, gear assemblies, brakes, etc. However, in the interest of completeness, specific mechanical components are described below.

The mast member 28 is constructed sufficiently rigid to support the said support framework described above with sufficient resiliency to guard against fracture under the widely disparate loading. The means for fastening the sail support framework to the mast member 28 can be conventional in nature and should be well known by those skilled in the art.

As indicated above, rotation of the mast member 28 may be accomplished mechanically either under the control of the sailor or under the power of the wind. For example, if it is desired to maintain a controlled incremental advancement of the mast member 28 in one direction or the other, a drive motor 60 shown in FIG. 6 can be energized to direct rotational movement. The drive motor 60 is connected via a drive shaft to a roller 62 positioned in frictional engagement with the mast member 28. In one embodiment of the mast member 28, a channel portion 64 is provided for the frictional acceptance of the roller 62. Thus rotation of the roller 62 upon operation of the drive motor results in movement of the mast member 28. The drive motor 60 should therefore be of a reversible direction type. With a drive motor employed in this fashion, the mast assembly 12 may be controlled remotely by a sailor positioned at the helm in the cockpit. When desired, the mast member 28 may be slowed down or stopped by actuating a stop or brake. In the preferred embodiment, a friction brake 66 is provided on one or more stanchions 30 to control rotation of the mast member 28 when desired. In order to permit manual rotation of the mast member 28 in the event the drive motor 60 is inoperable, a winch 68 linked to the roller 62 via a gear assembly (not shown) is provided. The winch 68 is employed in a fashion which permits the sailor to override the drive motor 60 to effectuate manual operation. In alternative embodiments, the roller 62 can be replaced by a pinion or helical gear compatible with a rack disposed on the underside of the channel portion 64 of the mast member 28.

When it is desired to change course or respond to changing wind conditions, it will likely be necessary to adjust the position of the sails to accommodate the change. With the present invention, the sailor can make the adjustment with similar efforts to those required with conventional sailing vessels. For example, assume that the sailing vessel 10 of the present invention is heading in a 0° direction (i.e., North) with a wind originating out of the West at 270°. In this heading, the sails 32 of the mast assembly 12 should be trimmed to a position similar to that shown in FIG. 4. The operation of the sailing vessel 10 can be appreciated by assuming that at some point along this heading, the sailor determines that a change in course is desired. Assume further that that change in course requires that the rudder be adjusted to turn the vessel into a 45° heading thereby positioning the vessel against a headwind of about 45° to the left, as shown in FIG. 5. In order to manipulate the mast assembly 12 into the position shown, the sailor may elect one of two distinct approaches. In one approach, the sailor can mechanically direct rotation of the mast member 28 by actuating the drive motor so as to trim the sails 32 to a relative position of 45° with respect to the longitudinal axis 50 of the sailing vessel. In this way, both the mast member 28 and the rudder 24 (FIG. 1) can be adjusted simultaneously. In an alternative approach, the sailor can direct the vessel toward the wind while simultaneously releasing the brakes 66 which hold the mast member 28 in place. Due to the configuration of the mast assembly 12, the mast member 28 will naturally have a tendency to turn into the wind, thus approaching alignment with the longitudinal axis 50 of the vessel 10. When the sails 32 have reached the proper position with respect to the vessel 10, the brakes 66 can be re-applied to retain the rotating mast member 28 in a desired position, preferably that shown in FIG. 5. It is intended that the brake release also be controlled remotely from the cockpit so that it is possible for the sailor to operate the steering mechanism (i.e., the rudder) and the brakes simultaneously.

With either alternative approach, a lone sailor is capable of operating the sailing vessel without the assistance of additional crew members. In contrast, larger conventional sailing vessels often require multiple crew members to operate the sheets while the captain maintains the helm. As such, the present invention offers operational advantages not found in the prior art. In addition, because the sails 32 are supported in the above-described fashion, i.e., on a rotating mast member 28 supported from a plurality of stanchions 30, the stress associated with a conventional cantilevered mast is eliminated. With the present invention, under normal wind conditions, a certain amount of wind forces captured in the sails are distributed to some of the stanchions 30 in compression while the balance of forces are distributed to other stanchions 30 in tension. Such load distribution provides a more durable system for operating sailing vessels.

Figure 7:
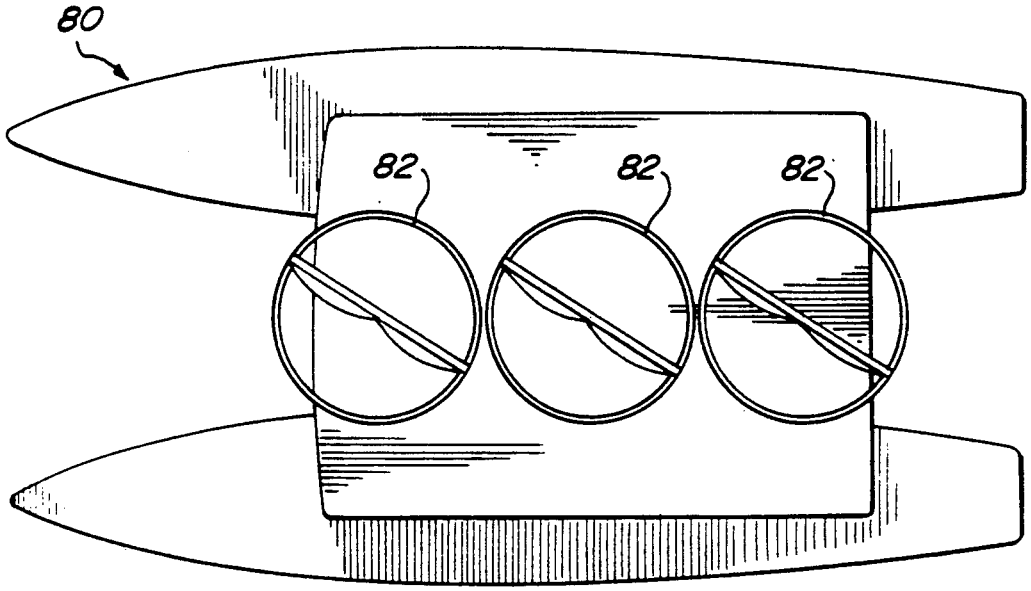
FIG. 7 is an alternative embodiment of the present invention showing multiple mast assemblies.

Referring now to FIG. 7, an alternative embodiment is shown on a vessel 80 comprising multiple mast assemblies 82, each similar in configuration and operation to the mast assembly 12 of the preferred embodiment. With this alternative embodiment, however, independent operation is permitted of the mast assemblies 82 if desired. As with the preferred embodiment, the mast assemblies are intended to be remotely operable from the cockpit by the captain. In addition, they are intended to be locally operated by turning conventional winches mechanically connected to each of the mast assemblies 82.

Figure 8:
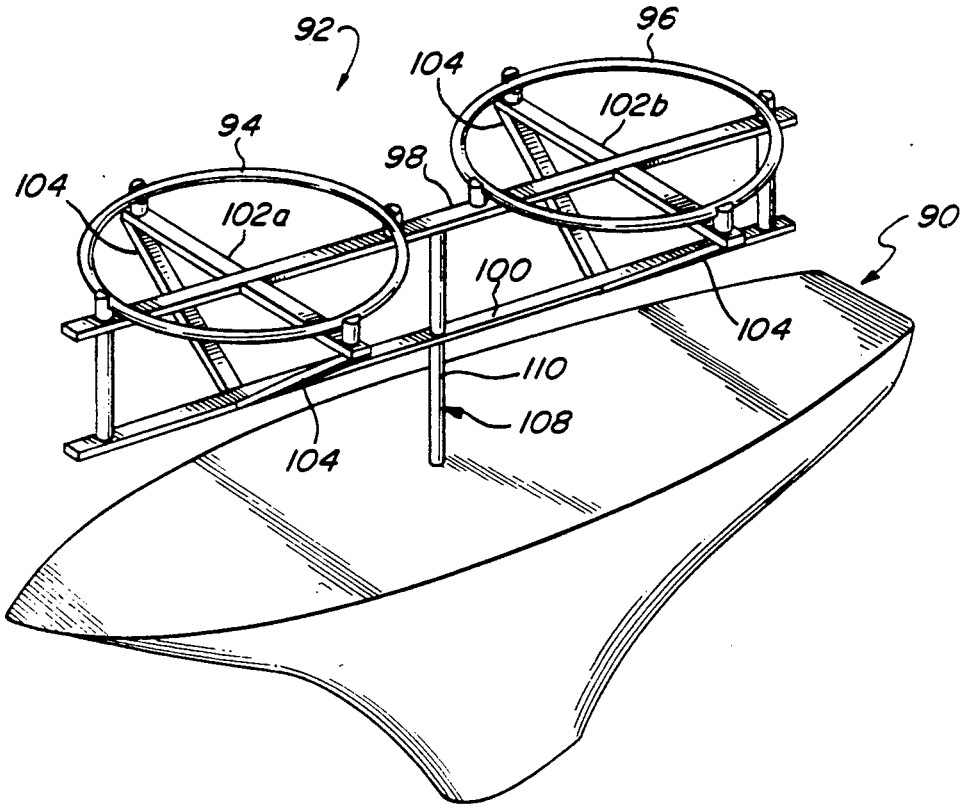
FIG. 8 is another alternative embodiment of the present invention showing multiple mast assemblies supported by an alternative support means.
Figure 9:
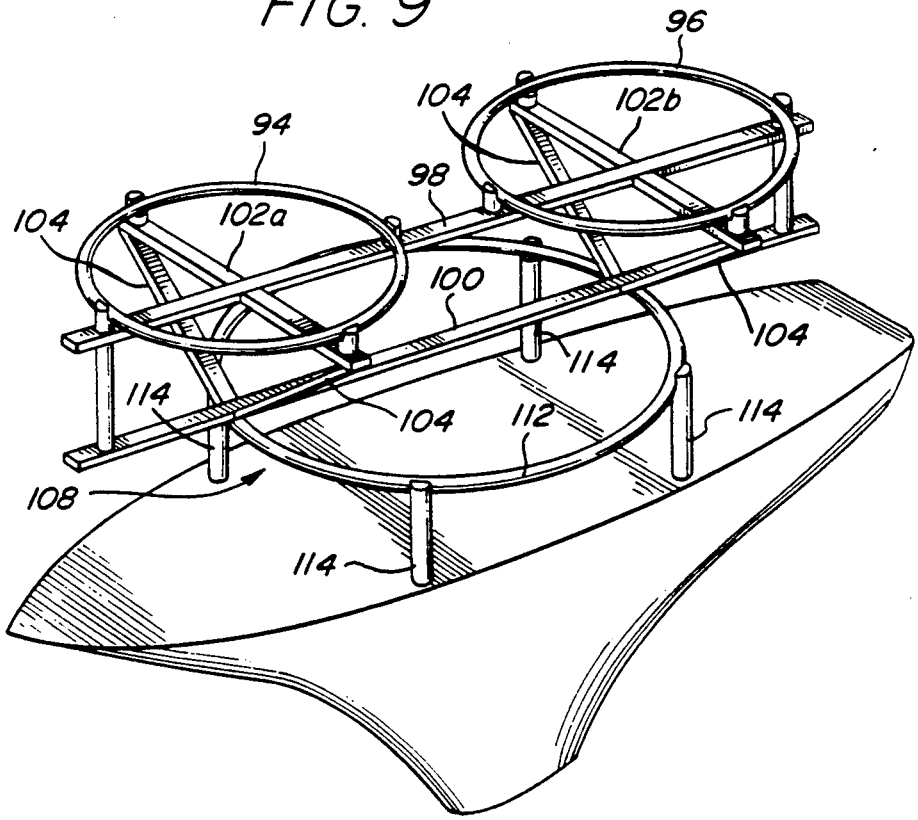
FIG. 9 is another alternative embodiment of the present invention showing multiple mast assemblies supported by another alternative support means.

Referring now to FIGS. 8 and 9, alternative embodiments of the present invention are shown employing multiple mast assemblies in a unique fashion. In FIGS. 8 and 9, other embodiments of the present invention are shown being incorporated on a single, displacement-hull vessel 90 and which comprise a mast assembly system 92 having a first and second mast assemblies 94, 96, respectively. As with the embodiment illustrated in FIG. 7, the mast assemblies of FIGS. 8 and 9 are structurally and functionally similar to the preferred embodiment described above in association with FIGS. 1–6. As such, the sails and frame supported above the mast assemblies are not shown in order to provide a clearer view of the lower components.

The variation in the embodiments of FIGS. 8 and 9 resides in the support of the multiple mast assemblies 94, 96. In both embodiments of FIGS. 8 and 9, the first and second mast assemblies 94, 96 are supported from dual structural beams 98, 100 wherein braces 102*a* and 102*b* are positioned orthogonally with beam 98. A pair of angles 104 are secured beneath each brace 102*a*, 102*b* so as to extend upwardly and outwardly from the lower beam 100. The braces 102*a,b* are securably affixed to the beams 98, 100 and function to stabilize the mast assemblies 94, 96 in such a manner as to provide controlled rotation thereof.

The advantageous feature of these embodiments is the collective movement of the multiple mast assemblies relative to the vessel. This advantage is achieved by incorporating a support means 108 below the mast assemblies 94, 96 which permits rotation of the beams 98, 100. As a matter of comparison, the embodiment of FIG. 7 comprises multiple mast assemblies which rotate independent of each other but which remain centrally fixed relative to the vessel. In contrast, the embodiments of FIGS. 8 and 9 permit collective movement of the mast assemblies via the support means 108.

In FIG. 8, the support means 108 comprises a vertical mast 110 which supports the beams 98, 100 so that rotation of both beams 98, 100 is permissible, thereby permitting collective rotation of the first and second mast assemblies 94, 96. Rotation of the beams 98, 100 may be controlled similarly to rotation of the rotating mast assembly described in association with FIGS. 1–6. That is, the beams 98, 100 are pivotably secured to the vertical mast 100 so as to be rotatable relative thereto. The vertical mast 110 remains rigidly affixed to the vessel 80. When it is desired to rotate the mast assemblies 94, 96 collectively, a brake (not shown), which sustains the beams 98, 100 in a fixed position, is released. The beams 98, 100 are then subject to the force of the wind upon the sails (FIGS. 1–5), which force is translated to the beams 98, 100 causing relative movement. When the beams 98, 100 have arrived at a second desired position relative to the vessel 80, the brake can be applied, thus re-sustaining the beams 98, 100 against wind forces. Incremental adjustment of the beam positions can be accomplished via a conventional drive mechanism (not shown) mounted to the vertical mast 110. If so desired, the entire rotational path travelled by the beams 98, 100 from one position to another can be achieved solely through operation of the drive mechanism rather than relaying on the force of the wind alone. The brake and drive mechanism necessary to control rotation of the beams 98, 100 are contemplated to be of conventional configuration and operation as are commonly found in the art and may be manual or automatic in nature. It is further anticipated that these mechanical components will function similarly to analogous components illustrated in FIG. 6 and described above in association therewith.

In contrast to the vertical mast 110 of FIG. 8, the support mechanism 108 of FIG. 9 comprises a mast assembly 112 which is functionally and structurally similar to the first and second mast assemblies 94, 96. In this regard, it is possible to collectively rotate the first and second mast assemblies 94, 96 similarly to the embodiment of FIG. 8. However, in contrast to direct rotation of the structural beams 98, 100 to achieve collective movement of the mast assemblies 94, 96, the latter embodiment may be collectively rotated by controlling movement of the lower mast assembly 112; i.e., with mechanical or wind power as well as stops and/or brakes. As with the preferred embodiment of the rotating mast assemblies described above, the lower mast assembly 112 is supported by a plurality of stanchions 114 which extend upwardly from the vessel 90 in a manner to permit free rotation of the mast assembly 112 relative to the vessel 80. Control of the rotation of the mast assembly 112 can be achieved by cooperating mechanical components such a brakes and drive mechanisms positioned on the stanchions 114 which are contemplated to operate similarly to the brakes and drive mechanisms described above in association with FIGS. 1–7.

The present invention may be embodied in other specific forms without departing from its spirit or essential characteristics. For example, regarding any one of the above-described mast assemblies, a ring-shaped track could be positioned in the upper ends of the stanchions so that the ring-shaped mast is capable of riding within or on the track. Alternatively, the mast need not include an outer ring, but may instead have outwardly extending beams which ride in a ring shaped support. As such, the described embodiments are to be considered in all respects only as illustrative and not restrictive and the scope of the invention is, therefore indicated by the appended claims rather than by the foregoing range of equivalency of the claims are to be embraced within their scope.

What is claimed is:

1. A system for powering a water vessel, said system comprising:

a plurality of spaced supports rigidly mounted to a support surface on the vessel and extending upwardly therefrom;

an annular mast rotatably supported by the supports;

a frame supported by the annular mast and secured thereto comprising a lower boom extending across and fixed to said mast, generally perpendicular to an axis of rotation of said mast, and an upper boom spaced upwardly from and generally parallel to the lower boom;

at least one sail extending between and secured to the booms; and a plurality of stabilizing braces on opposite sides of the upper and lower booms, the braces having a lower end secured to said annular mast and extending upwardly at an angle to said frame and secured to an upper portion of said frame adjacent the ends of said upper boom.

2. The system of claim 1 further comprising means for directing rotatable movement of the annular mast.

3. The system of claim 2 wherein the directing means comprises at least one releasable brake.

4. The system of claim 3 wherein the directing means comprises a mechanical drive system.

5. A system for powering a sail-powered vessel, said system comprising:

at least one sail;

a generally planar frame supporting and surrounding the sail, including a lower boom and an upper boom joined by a pair of spaced boom supports;

rotatably mounted mast means supporting the frame, the lower boom extending across the mast means and said boom supports extending vertically above the lower boom;

a plurality of braces on opposite sides of said frame extending diagonally between said mast means and upper portions of said frame to provide support and rigidity to the frame and mast means combination; and first support means extending upwardly from the vessel for supporting the mast means, wherein one of said means includes a ring defining a rotational path for said most means.

6. The system of claim 5 wherein the mast means includes said ring.

7. The system of claim 5 further comprising a second support means for rotatably supporting the first support means.

8. The system of claim 7 wherein the mast means and the second support means are independently rotatable.

9. A system for powering a sail-powered vessel, comprising:

at least one sail;

a frame for supporting the sail, including a lower boom and an upper boom joined by a pair of spaced mast supports;

first rotatable mast means for supporting the frame, including a rotatably mounted ring, with said lower boom extending across and being secured to said ring;

support means for supporting the first mast means, including spaced upper and lower beams, with said upper beam extending beneath said ring, and bracing extending from said lower beam upwardly and outwardly to further support said mast means; and second rotatable mast means for supporting the beams.

10. The system of claim 9 wherein the first and second mast means are independently rotatable.

11. A method of supporting one or more sails on seafaring vessel, said method comprising the steps of:

securing one or more sails to a structural framework formed of upper and lower booms joined by spaced mast supports so as to permit exposure of said sails to the forces of wind for forward propulsion of the vessel;

rigidly supporting the framework on an annular rotatable mast member, with said lower boom being rigidly secured to the member and with bracing on both sides of said framework extending upwardly at an angle from said member to support the upper portion of said framework such that rotation of the member causes rotation of the framework; and rotatably supporting the member above the vessel.

12. The method of claim 11, further comprising the step of rotatably supporting the support for said member such that the support is rotated relative to the vessel.

13. The method of claim 12 wherein the step of rotating the mast member and the step of rotating the support are independent of each other.

14. A method of maneuvering one or more sails on a seafaring vessel, said method comprising the steps of:

providing support means for supporting a rotating ring-shaped member above the vessel;

securing a generally planar frame on said rotating member, said frame comprising upper and lower booms extending generally perpendicular to the axis of said rotating member and joined by a pair of spaced mast supports, the frame being secured by having the lower boom extending across and being secured to said member, and by extending bracing between said member and the upper portion of said frame on both sides of the frame;

securing a sail to said frame;

applying at least one brake mounted to the rotating member so as to reduce circumferential movement of the rotating member in either direction;

releasing the brake so as to permit rotating movement of the rotating member; and directing movement of the rotating member in a rotational fashion so as to direct simultaneous rotation of the sail.

15. The method of claim 14 wherein the step of directing movement of the rotating member comprises actuating a drive motor which is mechanically linked to said rotating member so as to cause said member to rotate relative to the support means.

16. The method of claim 14 wherein the step of directing movement of the rotating member comprises permitting the wind to drive the sail in a rotational fashion thus simultaneously driving the rotating member relative to the support means.

17. The method of claim 14 wherein the step of directing movement of the member comprises rotating a mechanical crank means mechanically linked to said member so as to cause said member to rotate about the support means.

18. The method of claim 14 further comprising the step of rotating the support means relative to the vessel.

19. The method of claim 18 wherein the step of rotating the support means and the step of directing movement of the member are independent steps.

20. A method of supporting one or more sails on a seafaring vessel, said method comprising the steps of:

affixing a plurality of supports on the vessel and laterally spacing said supports from each other so that said supports extend upwardly above the vessel;

rotatably supporting above the vessel an annular member above the plurality of supports so as to permit the passage of a person under said member, said member supporting a frame for retaining at least one sail secured to the frame, the frame including a lower boom affixed to said member, an upper boom spaced above said lower boom and defining a plane with the lower boom, said supporting step including extending bracing from said annular member on each side of said frame upwardly and at an angle and connected to the upper portion of said frame to help support the frame; and directing rotation of the member.

21. The method of claim 20 further comprising the step of rotatably supporting the plurality of supports such that said plurality of supports are collectively rotatable relative to the vessel.

22. The method of claim 20 wherein the step of directing rotation comprises releasing at least one brake provided on at least one of the plurality of supports.

23. The method of claim 20 wherein the step of directing rotation comprises actuating a mechanical drive system provided on at least one of the plurality of supports.

24. A system for powering a water vessel, said system comprising:

a plurality of stanchions rigidly mounted to the vessel and extending upwardly therefrom;

a ring mast rotatably supported by said stanchions;

a lower boom secured directly on said ring mast and extending horizontally across said ring mast in a diametric fashion through the center line of rotation of said ring mast;

an upper boom aligned parallel with said lower boom but spaced above said lower boom;

spaced mast supports positioned proximate to the opposite ends of said upper and lower booms and supporting said upper boom;

at least one sail secured between the upper and lower booms;

a plurality of struts provided on opposite sides of said upper and lower booms, which are directly engaged to the ring mast at their lower ends and with said upper boom at their upper ends; and means to direct rotatable movement of said ring mast.

25. The system of claim 24, wherein the means to direct rotatable movement of said ring mast comprises a mechanical drive system.

26. The system of claim 24, wherein the means to direct rotatable movement of said ring mast comprises at least one releasable brake.

* * * * *